US005298682A

United States Patent [19]

Salz

[11] Patent Number: 5,298,682

[45] Date of Patent: Mar. 29, 1994

[54] OPTIMIZED SYMMETRICAL COAXIAL CABLE

[75] Inventor: David B. Salz, Dania, Fla.

[73] Assignee: Wireworld by David Salz, Inc., Fort Lauderdale, Fla.

[21] Appl. No.: 936,360

[22] Filed: Aug. 20, 1992

[51] Int. Cl.[5] ..... 174 120 R; H01B 7/18; H01B 9/04

[52] U.S. Cl. ..... 174/105 R

[58] Field of Search ..... 174/105 R, 109, 108, 174/120 R, 120 SR, 121 R, 131 R, 113

[56] References Cited

U.S. PATENT DOCUMENTS

| | | | |
|---|---|---|---|
| 2,342,736 | 6/1941 | Herzog et al. | 174/108 X |
| 2,376,101 | 5/1945 | Tyzzer | 174/105 RX |
| 4,200,126 | 4/1980 | Fish | 174/109 X |
| 4,376,920 | 3/1983 | Smith | 174/105 R |
| 4,477,693 | 10/1984 | Krabec et al. | 174/105 R |
| 4,487,996 | 12/1984 | Rabinowitz et al. | 174/105 R |

*Primary Examiner*—Timothy V. Eley
*Assistant Examiner*—Khan V. Nguyen
*Attorney, Agent, or Firm*—Malin, Haley, DiMaggio & Crosby

[57] ABSTRACT

A coaxial audio cable is provided having a core, braided inner and outer conductors, dielectric layer between the inner and outer conductor and a jacket surrounding the outer conductor. The inner conductor is disposed around the core at a braid angle of approximately eighteen degrees. The dielectric layer is wrapped around the braided inner conductor. The outer conductor is disposed around the dielectric layer at a braid angle of approximately thirty-eight degrees. The cable is designed to provide a 5:6 overall ratio between the number of strands in the inner conductor and the number of strands in the outer conductor. The inner and outer conductors of the coaxial audio cable are designed to have matching series impedances.

22 Claims, 2 Drawing Sheets

OPTIMIZED SYMMETRICAL COAXIAL CABLE

BACKGROUND OF THE INVENTION

1. Field of the Invention

This invention relates generally to coaxial cables and in more particular to a coaxial cable having inner and outer conductors with matching series impedances for audio applications.

2. Description of the Prior Art

Coaxial cables for use in a variety of purposes are well known. Coaxial cables are made in three general types for different applications: flexible, semirigid or rigid. The more rigid the cable, the more predictable and stable its electrical properties. A few examples of such cables are U.S. Pat. No. 2,436,421 issued to Cork, U.S. Pat. No. 2,342,736 issued to Herzog et al., U.S. Pat. No. 1,781,092 issued to Affel et al., and U.S. Pat. No. 3,351,706 issued to Gnerre et al.

U.S. Pat. No. 1,781,092 to Affel discloses to a conducting system for transmitting with small attenuation a band of frequencies. The conducting system employs a circuit having concentric conductors of relatively large diameter, one acting as return for the other. The inner conductor is formed by spirally winding a plurality of wires about a suitable core, thus forming in effect a hollow conducting shell. Dielectric spacing washers are mounted upon the inner shell to form a support for the outer conductor. The outer conductor is formed by spirally winding a plurality of wires over the outer surfaces of the supporting washers to form an outer conducting shell. A waterproof covering then surround the entire surface of the outer conductor to protect the system from moisture.

U.S. Pat. No. 2,342,736 to Herzog et al. discloses to a wide-band radio cable of constant attenuation which is suitable for distortionless transmission up to a certain frequency value. The cable includes an internal conductor consisting of interlaced radio strands and is seated on a hemp-cord. The conductor is embedded in a plastic insulating compound. The outer conductor consists of interlaced radio strands and is mounted on the insulating compound surrounded with an insulating sheath.

U.S. Pat. No. 2,436,421 to Cork discloses to the transmission of electrical energy by electric cables of the concentric line type. The cable includes an inner conductor of drawn copper wire which is held centrally of a sheath of insulating material by a thread of the same material. The outer conductor consists of a braided sheath composed of strands of copper wire. The individual strands being insulated from each other by enamelling or shellac. The outer protective covering of the cable consists of a sheath of polyethylene.

U.S. Pat. No. 3,351,706 to Gnerre et al. discloses to a submarine coaxial cable consisting of a central metallic conductor embedded in a layer of dielectric material and with a braided conductor of wire strands located between an inner layer of solid dielectric and an outer layer of solid dielectric. Both conductors are copper or other highly conductive material and the dielectric layers are of a polyolefinic material.

The prior art fails to provide a coaxial cable having an inner and outer conductor having matching series impedances. By having matching series impedances, a superior signal can be transmitted by the cable. Such superior signal transmission is highly desirous for use with premium-quality sound systems. It is, therefore, to the effective resolution of the aforementioned problems and shortcomings that the present invention is directed.

SUMMARY OF THE INVENTION

The present invention discloses a coaxial cable for use in premium-quality audio systems. The cable includes a braided, coated, inner and outer conductor. The inner conductor is disposed along a hollow tubular core at a braid angle of approximately eighteen degrees. A dielectric layer composed of spiral-wrapped teflon or microporous teflon tape is wrapped around the inner conductor to insulate the inner conductor from the outer conductor. The outer conductor is disposed along the dielectric layer at a braid angle of approximately thirty-eight degrees. The number of strands in the inner and outer braids are chosen to provide a 5:6 ratio between the number of strands in the inner braid and the number of strands in the outer braid. A jacket insulates the outer conductor.

The inner and outer conductors are configured according to a specific combination/formula of strand diameters, strand quantities, and braid angles in order that the conductors have optimized and matched, thus symmetrical, impedance for superior sound quality.

Accordingly, the primary object of the invention is to provide a coaxial cable having inner and outer conductor which have matching series impedances.

It is another object of the invention to provide a coaxial cable which will accurately transmit high quality audio signals for use in premium-quality audio systems.

It is a further object of the invention to provide a coaxial cable having optimum electrical characteristics to accurately transmit high quality audio signals.

It is yet another object of the invention to provide a coaxial cable which minimizes electro-mechanical intermodulation distortion of an audio signal.

Other objects and advantages of this invention will become apparent from the following description taken in conjunction with the accompanying drawings wherein set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
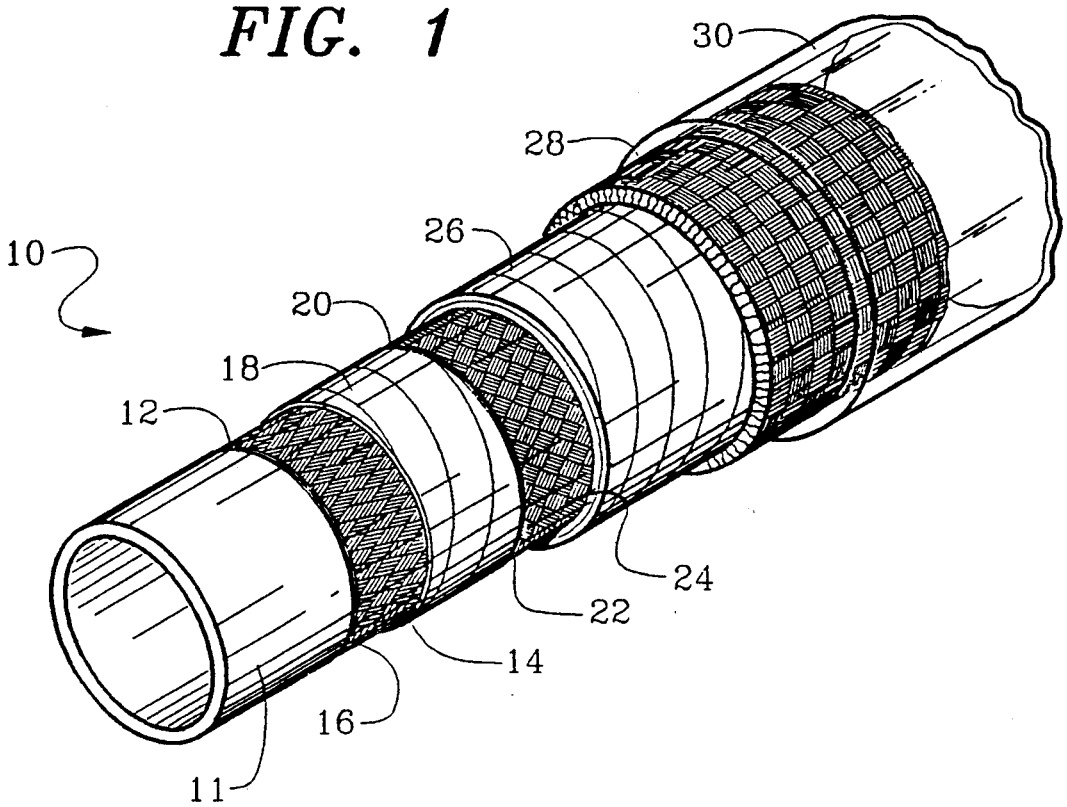
FIG. 1 is a fragmentary perspective view of the cable with the casing layers progressively broken away.
Figure 2:
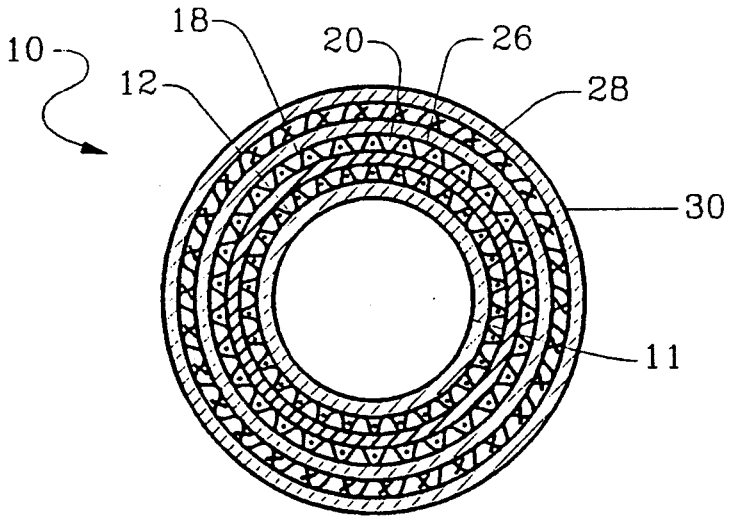
FIG. 2 is a cross sectional view on line 2—2 of FIG. 1.
Figure 3:
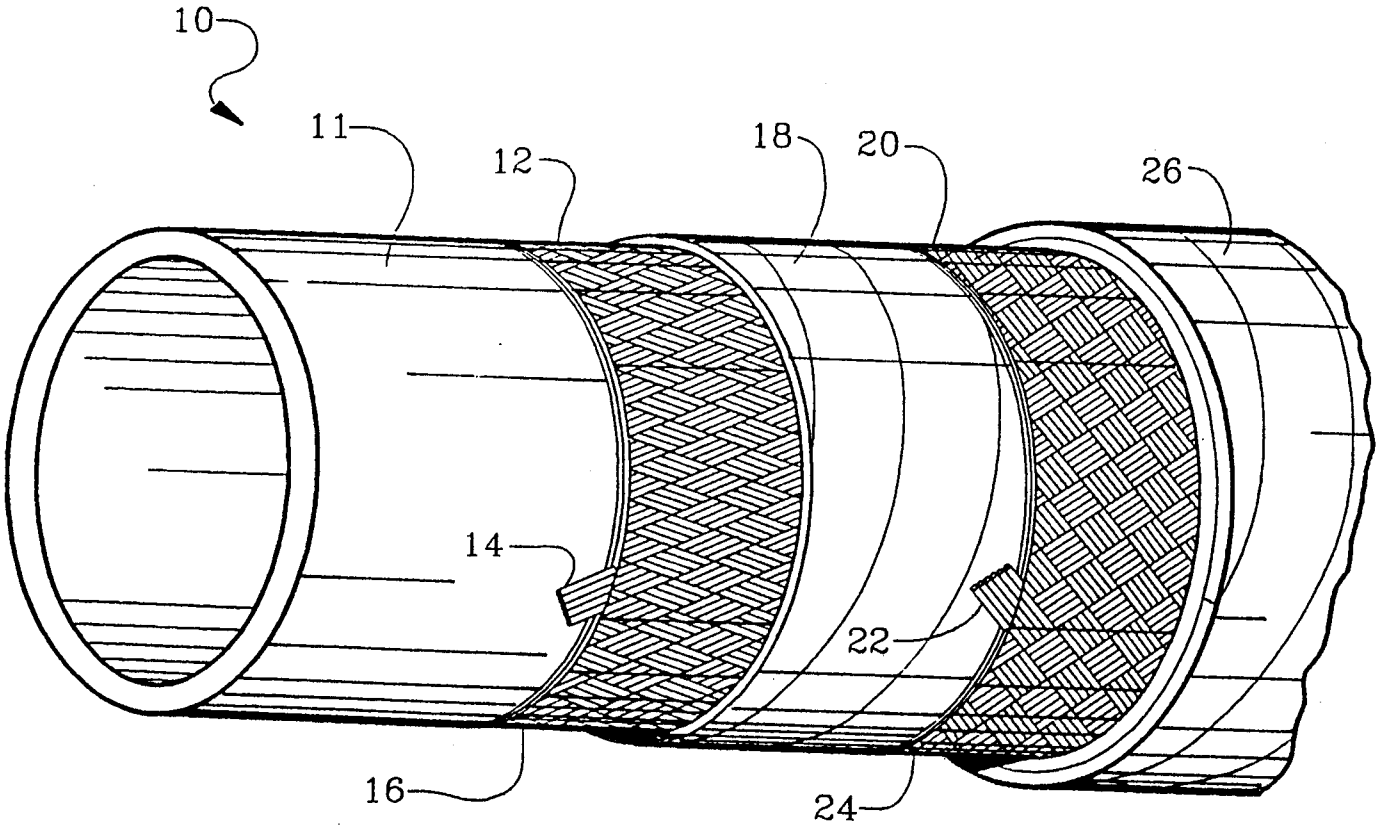
FIG. 3 is a cut away view of the inner and outer conductors of FIG. 1.

Referring more particularly to the drawings a coaxial cable is generally shown at 10 consisting of a central plastic tubular core 11, concentric tubular braided inner conductor 12 made up of individually insulated strands 16, dielectric layer 18, concentric tubular braided outer conductor 20 made up of individually insulated strands 24, and an extruded thermoplastic jacket 30. Core 11 is used to support inner (positive) conductor 12. Preferably, the plastic core is constructed of polyethylene which can either be hollow or solid. Inner conductor 12 is shown braided and disposed along core at a braid angle of approximately eighteen (18) degrees. Preferably, each braid 14 is made up of individually insulated copper or silver strands. The inner (positive) conductor is a tubular braid 12 which matches the series impedance of the outer (negative) conductor tubular braid 20.

Preferably, the strands, which make up the inner and outer braids, can be individually dispersion-coated with a plastic film (preferably, polyester) to prevent surface oxidation and the associated non-linear conduction (copper oxide being semiconductive) between strands due to skin and proximity effects and vibration (due to both external vibration and/or the EMF of the signal). An additional benefit of the coated strands is long-term consistency of performance due to the elimination of surface oxidation of the strands. Coated strands 16 and 24 eliminate the intermodulation of audio-frequency signals caused by the imperfect and inconsistent contact between strands which varies with signal level, frequency, and vibration. The preferred coating for strands 16 and 24 is solderable polyester.

For use as a speaker cable a wire gauge of AWG #32 is preferred for each strand, while for use as a line-level cable a wire gauge of AWG #36 is preferred. However, the range of wire gauges which may provide sufficient results could extend from #28 to #40.

Dielectric layer 18 can be composed of either a spiral-wrapped teflon or microporous teflon tape. The compliant, elastic consistency of these tapes stabilizes and damps movement between strands 16 and 24 of the conductor braids to minimize both vibrationally and electromagnetically induced intermodulation distortion. The exceptionally low dielectric constants of teflon and air-spaced teflon allow cable 20's conductors 12 and 20 to be closely spaced for low inductance while maintaining relatively low capacitance. The unmatched high temperature capability of teflon allows conductors 12 and 20 to be tinned by dipping in molten solder without damaging the dielectric. Though teflon is preferred, it is possible that another material such as radiation cross-linked polyethylene or polypropylene foam could be an adequate substitute. However, the use of such substitutes would cause the mechanical and high temperature durability to be compromised.

The thickness of dielectric layer 18 may vary to yield an outer to inner diameter (D/d) ratio (of effective electrical diameters) within the range of 1.3 to 1.6. This range has been found to provide the most favorable range of electrical characteristics for accurate transmission of high quality audio signals.

Outer conductor 20 is also braided and is made from the same type and gauge strands as braided inner conductor 12. The number of strands 24 in the outer conductor braid 20 is chosen to provide a 5:6 ratio between the number of strands in inner conductor braid 12 and the number of strands in outer conductor braid 20. The number of strand groups in inner conductor 12 is equal to the number of strand groups in outer conductor 20. Thus, if inner conductor strand groups contains five (5) strands then outer conductor strand groups would contain six (6) strands. Accordingly, if ten (10) strands were chosen for each inner conductor strand group, then twelve (12) strands would be utilized for each outer conductor strand group.

It is to be understood, that combinations other than the one described above, can be utilized to achieve the 5:6 strand ratio between conductors 12 and 20. In one combination the same number of strands are chosen for each strand group in inner conductor braid 12 and each strand group in outer conductor braid 20. In this combination, the outer conductor will contain 20% more strand groups than the inner conductor in order to achieve the desired 5:6 overall strand ratio between the respective conductors 12 and 20. Specifically, in this combination, for every five (5) strand groups in inner conductor 12 there will be six (6) strand groups in outer conductor 20. Accordingly, if ten (10) strand groups are chosen for inner conductor 12, then twelve (12) strand groups will be chosen for outer conductor 20. Thus, in this second combination where the same number of strands is chosen for the strand groups that make up both conductors 12 and 20, in order to obtain matching series impedances between the respective conductors 12 and 20, a 5:6 ratio must be present between the number of strand groups in inner conductor 12 and the number of strand groups in outer conductor 20.

Another combination could include having a different number of strands per strand group in the inner conductor 12 than in the outer conductor 20, as well as having a different number of strand groups for inner conductor 12 than outer conductor 20. In this scenario, the ratio of strand groups and strands per group would differ from the ratios described above. However, the overall 5:6 ratio of inner braid strands to outer braid strands would still be achieved. Lastly, other combinations are possible producing the desired results. For the several combinations described above, it should be noted that the diameters of each strand in inner conductor 12 and each strand in outer conductor 20 always remain the same.

Outer conductor 20 is disposed along dielectric layer 18 at an angle of approximately thirty-eight (38) degrees. This combination of a 5:6 strand ratio, eighteen degree inner braid angle and thirty-eight outer braid angle allows both braids to have matching series impedance. Lastly, an extruded thermoplastic jacket 30 is provided to provide protection to outer and inner conductors 12 and 20. The preferred material for jacket 30 is PVC. The jacket can be clear for aesthetic purposes.

It should be understood that the inner braid angle of eighteen degrees and the outer braid angle of thirty-eight degrees are nominal values which can be adjusted and still provide an optimum coaxial cable in accordance with the principles of the instant invention.

An optional spiral wrapped layer of soft teflon tape 26 can be wrapped around outer conductor 20 to damp vibration and increase the mechanical stability of outer conductor braid 20. Additionally, a textile braid 28 of sufficient density can be disposed around outer conductor 20, or optional teflon tape 26 if provided, to provide mechanical and thermal isolation of outer conductor 20 from extruded jacket 30.

In an alternative design braided conductors consisting of flat ribbon-style strands will be utilized. This design shares all of the advantages of the preferred round wire design and is made to work utilizing the same principles as those with the round-wire design. However, the flat-ribbon design offers more design flexibility over the round-wire design, especially since the thickness and width of the ribbons can be varied independently.

In a first flat-ribbon design, equal number of strands (ribbons) in the inner and outer braids are utilized. The ribbons which comprise the inner braid are approximately 80% to 85% as wide as those which make up the outer conductor braid. In this design the ribbons utilized for the inner and outer braids are of an equal thickness.

In a second flat-ribbon design, the ribbons in the inner and outer braids are the same width, dimension and type. In this second design, there are approximately 20% more ribbons in the outer braid than in the inner braid. Other designs utilizing a combination of different width sizes for the ribbons in the inner braid as compared to the ribbons in the outer braid and a different number of ribbons in the inner braid as compared to ribbons in the outer braid are possible. Additionally, further combinations are possible utilizing a combination of ribbon number and widths, as well as varying the thickness of the ribbons and varying the braid angles of the inner conductor and the outer conductor.

The present invention combines the advantages of symmetrical positive and negative conductors with the unique benefits and capabilities of concentric tubular conductors to provide superior cables for line-level audio and loudspeaker applications.

It is to be understood that while I have illustrated and described certain forms of my invention, it is not to be limited to the specific forms or arrangement of parts herein described and shown. It will apparent to those skilled in the art that various changes may be made without departing from the scope of the invention and the invention is not to be considered limited to what is shown in the drawings and described in the specification.

What I claim is:

1. A symmetrical coaxial cable, comprising: a core having an axis; a braided inner conductor constructed of a first quantity of wire strands, the first quantity of wire strands disposed along said core at an angle of approximately eighteen degrees with respect to the axis of the core, said core supporting said inner conductor; means for insulating said inner conductor, said means for insulating disposed along said inner conductor; a braided outer conductor constructed of a second quantity of wire strands, the second quantity of wire strands disposed along said means for insulating at an angle of approximately thirty eight degrees with respect to the axis of the core; and means for protecting said inner and outer conductors from atmospheric elements disposed along said outer conductor; wherein said cable having a 5:6 overall ratio between the quantity of strands in said inner conductor and the quantity of strands in said outer conductor; wherein said quantities of strands in said inner conductor and in said outer conductor and the angles that said inner conductor and said outer conductor are disposed at are chosen in order for said inner conductor and said outer conductor to have matching series impedances.

2. The symmetrical coaxial cable of claim 1, wherein said inner conductor and said outer conductor are made up of an equal number of strand groups and said outer conductor being constructed of more strands than said inner conductor in order to achieve the 5:6 overall ratio between the quantity of strands in said inner conductor ad the quantity of strands in said outer conductor.

3. The symmetrical coaxial cable of claim 1, wherein said inner conductor and said outer conductor are made up of a number of strand groups, wherein the strand groups which make up the inner conductor and the strand groups which make up the outer conductor are constructed of an equal quantity of wire strands and said outer conductor having more strand groups than said inner conductor in order to achieve the 5:6 overall ratio between the quantity of strands in said inner conductor and the quantity of strands in said outer conductor.

4. The symmetrical coaxial cable of claim 1, wherein said strands are individually dispersion-coated with a plastic film to prevent surface oxidation and the associated non-linear conduction between strands due to skin and proximity effects and vibration.

5. The symmetrical coaxial cable of claim 1, wherein said means for protecting is an extruded thermoplastic jacket.

6. The symmetrical coaxial cable of claim 1, wherein said means for insulating is a dielectric layer composed of spiral-wrapped teflon.

7. The symmetrical coaxial cable of claim 1, wherein said means for insulating said inner conductor is a dielectric layer composed of microporous teflon tape.

8. The symmetrical coaxial cable of claim 1, further including a means for insulating said outer conductor disposed along said outer conductor.

9. The symmetrical coaxial cable of claim 8, wherein said means for insulating said outer conductor is a spiral wrapped layer of soft teflon tape wrapped around said outer braided conductor to damp vibration and increase mechanical stability of said outer conductor.

10. The symmetrical coaxial cable of claim 1, further including a textile braid disposed between said outer conductor braid and said means for protecting to provide mechanical and thermal isolation of said outer conductor from said means for protecting.

11. The symmetrical coaxial cable of claim 8, further including a textile braid disposed between said means for insulating said outer conductor and said means for protecting to provide mechanical and thermal isolation of said outer conductor from said means for protecting.

12. A symmetrical coaxial cable, comprising: a core having an axis; a braided inner conductor constructed of a quantity of inner flat ribbon-style strands, the inner flat ribbon-style strands disposed along said core at an angle of approximately eighteen degrees with respect to the axis of the core, said core supporting said inner conductor; means for insulating said inner conductor, said means for insulating disposed along said inner conductor; a braided outer conductor constructed of a quantity of outer flat ribbon-style strands, the outer flat ribbon-style strands disposed along said means for insulating at an angle of approximately thirty eight degrees with respect to the axis of the core; and means for protecting said inner and outer conductors from atmospheric elements disposed along said outer conductor; wherein the quantity of each said flat ribbon-style strands in said inner conductor and said outer conductor, width of each flat ribbon-style strand and the angles that said inner conductor and said outer conductor are disposed at are chosen in order for said inner and outer conductors to have matching series impedances.

13. The symmetrical coaxial cable of claim 12, wherein the quantity of flat ribbon-style strands in said inner conductor and said outer conductor are equal and the flat ribbon-style strands in said inner conductor are approximately 80 to 85 percent as wide as the flat ribbon-style strands in said outer conductor.

14. The symmetrical coaxial cable of claim 12, wherein the width of each said flat ribbon-style strands in said inner conductor and said outer conductor are equal and there are approximately 20 percent more flat ribbon-style strands in said outer conductor than in said inner conductor.

15. The symmetrical coaxial cable of claim 12, wherein said flat ribbon-style strands are individually dispersion-coated with a plastic film to prevent surface oxidation and the associated non-linear conduction between said flat ribbon-style strands due to skin and proximity effects and vibration.

16. The symmetrical coaxial cable of claim 12, wherein said means for protecting is an extruded thermoplastic jacket.

17. The symmetrical coaxial cable of claim 12, wherein said means for insulating is a dielectric layer composed of spiral-wrapped teflon.

18. The symmetrical coaxial cable of claim 12, wherein said means for insulating said inner conductor is a dielectric layer composed of microporous teflon tape.

19. The symmetrical coaxial cable of claim 12, further including a means for insulating said outer conductor disposed along said outer conductor.

20. The symmetrical coaxial cable of claim 19, wherein said means for insulating said outer conductor is a spiral wrapped layer of soft teflon tape wrapped around said outer braided conductor to damp vibration and increase mechanical stability of said outer conductor.

21. The symmetrical coaxial cable of claim 12, further including a textile braid of sufficient density disposed between said outer conductor and said means for protecting to provide mechanical and thermal isolation of said outer conductor from said means for protecting.

22. The symmetrical coaxial cable of claim 19, further including a textile braid of sufficient density disposed between said means for insulating said second conductor and said means for protecting to provide mechanical and thermal isolation of said outer conductor from said means for protecting.

* * * * *